United States Patent [19]

Mastroianni et al.

[11] 4,166,798

[45] Sep. 4, 1979

[54] ELECTRICAL DEVICE WITH FLUORINATED DIVALENT SULFUR DIELECTRIC GAS

[75] Inventors: Martin J. Mastroianni, East Aurora; Sabatino R. Orfeo, Orchard Park; Bernard Sukornick, Williamsville, all of N.Y.

[73] Assignee: Allied Chemical Corporation, Morris Township, Morris County, N.J.

[21] Appl. No.: 934,758

[22] Filed: Aug. 21, 1978

[51] Int. Cl.[2] ..... H01B 3/56

[52] U.S. Cl. ..... 252/63.5; 174/17 GF; 252/63.7

[58] Field of Search ..... 252/63.7, 63.5; 174/17 GF, 25 G; 260/327 E, 327 H, 454, 609 R

[56] References Cited

U.S. PATENT DOCUMENTS

| | | | |
|---|---|---|---|
| 3,059,044 | 10/1962 | Friedrich et al. | 174/18 |
| 3,136,744 | 6/1964 | McGrew | 260/327 E |
| 3,390,091 | 6/1968 | Eibeck | 252/63.5 |
| 3,674,696 | 7/1972 | Griffiths | 252/63.7 |
| 4,052,555 | 10/1977 | Mears et al. | 174/17 GF |
| 4,071,461 | 1/1978 | Mears et al. | 252/63.5 |

*Primary Examiner*—Harris A. Pitlick

*Attorney, Agent, or Firm*—Alan M. Doernberg; Jay P. Friedenson

[57] ABSTRACT

Electronegative, normally gaseous, fluorinated compounds with sulfur at valence state 2 act as good dielectric gases alone or in combination with sulfur hexafluoride. In particular bis (trifluoromethyl) sulfide has a higher dielectric strength than sulfur hexafluoride when used alone and increases dielectric strength of sulfur hexafluoride in blends.

10 Claims, No Drawings

ELECTRICAL DEVICE WITH FLUORINATED DIVALENT SULFUR DIELECTRIC GAS

BACKGROUND OF THE INVENTION

Dielectric gases have found increasing use in high voltage systems, especially over about 100 kilovolts, with the most widely used material being sulfur hexafluoride. Sulfur hexafluoride has been used in both devices with uniform fields, such as compressed gas insulative devices, and in devices with non-uniform fields, such as circuit breakers and transformers. The rating of a particular device depends upon its configuration, the gas pressure, the dielectric gas used, the degree of freedom of the gas from moisture and other contamination, and other conditions. Nevertheless, there is a continuing need for dielectric gases of increased dielectric strength under comparable conditions that permit a given device to merit a higher voltage rating or permit alterations in other parameters with the maintenance of a rating.

Various gases, especially electronegative gases, have been proposed as additives to sulfur hexafluoride or alternates for sulfur hexafluoride. Some such gases also contain sulfur while others do not. The proposed substitutes and alternates to sulfur hexafluoride which contain sulfur, have one or more sulfur atoms at valence state 6 or 4 or otherwise bonded with four or six electron pairs. Exemplary in U.S. Pat. No. 3,674,696 (issued July 4, 1972 to Griffiths) wherein compounds are disclosed as dielectric gases with S at valence state 4 such as $SN(CF_3)F_2$, $SN(C_2F_5)F_2$, $SN(C_3F_7)F_2$ or S at valence state 6 such as $SN(CF_3)OF_2$, $SN(C_3F)_7OF_2$, $S(NCF_3)_2F_2$, $S(NCF_3)F_2$ and $S(NC_2F_5)(NC_3F_7)F_2$. It has hitherto been thought, howver, that sulfur at valence state 2 was too easily oxidized to offer high dielectric strength in a dielectric gas.

BRIEF DESCRIPTION OF THE INVENTION

The present invention includes an improvement in a high voltage electrical apparatus having at least two electrical conductors separated by an insulative dielectric gas subjected to an electrical field, in which improvement the insulative gas comprises about 0.5 to 100 mole% of a divalent sulfur compound selected from the group consisting of tetrafluorothiirane, hexafluorothietane, bis(trifluoromethyl) sulfide, perfluoromethyl ethyl thioether, perfluorodiethyl thioether, trifluoromethyl thiocyanate and mixtures thereof and 0 to about 99.5 mole% sulfur hexafluoride. The electrical device may be of the type wherein the dielectric gas is subjected to a uniform field or of the type wherein the dielectric gas is subject to a non-uniform field.

The present invention also includes as a novel composition of matter a dielectric gas comprising between about 10 and about 90 mole% of the above divalent sulfur compound and between about 10 and about 90 mole% sulfur hexafluoride. The preferred divalent sulfur compound for both the present electrical apparatus and the present composition of matter is bis (trifluoromethyl) sulfide.

DETAILED DESCRIPTION OF THE INVENTION

The present divalent sulfur compounds are of three types: bis(prefluoroalkyl) sulfides of the formula $(R)_2S$ where R is $CF_3$— or $C_2F_5$—, perfluoro-cycloalkylsulfides of the formula

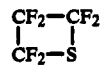

(called herein tetrafluorothiirane) and

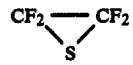

(called herein hexafluorothiethane) and the compound trifluoromethyl thiocyanate $CF_3$—S—CN.

The three bis (purfluoroalkyl) sulfides may be considered perfluorinated thioethers using the following nomenclature:

1. $CF_3$—S—$CF_3$ can be called bis (trifluoromethyl) sulfide or perfluorodimethyl thioether;
2. $CF_3$—S—$C_2F_5$ can be called perfluoromethyl ethyl sulfide or perfluoromethyl ethyl thioether; and
3. $C_2F_5$—S—$C_2F_5$ can be called bis (perfluoroethyl) sulfide or perfluorodiethyl thioether.

Each of these three compounds are known, with methods of synthesis and certain physical properties being described in Vol. 14 of *Inorganic Synthesis* (McGraw Hill, 1973), submission by D. T. Sauer and J. Shreeve beginning on page 42 at pages 44–45 for the bis (trifluoromethyl) sulfide and in D. T. Sauer and J. M. Shreeve, "Bis (perfluoralkyl) Sulfur Difluorides and Bis (Perfluoroaralkyl) Sulfoxides," *Journal of Fluorine Chemistry* Volume 1, pages 1–11 (1971–1972), especially at pages 9 and 10. Briefly, $CF_3SCl$ is reacted with $AgO\overset{o}{C}CF_3$ or $AgO\overset{o}{C}C_2F_5$ to produce $CF_3SO\overset{o}{C}CF_3$ or $CF_3SO\overset{o}{C}C_2F_5$ and this product is decarboxylated with ultraviolet light to produce $CF_3SCF_3$ or $CF_3SC_2F_5$. Perfluorodiethyl thioether may be similarly prepared from $AgO\overset{o}{C}C_2F_5$ and $C_2F_5SCl$ or by the reaction of $SF_4$ with $C_2F_4$.

Tetrafluorothiirene $CF_2$—$CF_2$ is a known compound, with a method for its synthesis reported by W. R. Brasen et al. in volume 30 of the *Journal of Organic Chemistry*, beginning on page 1488 (1965), especially page 4190. Hexafluorothietane

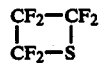

is believed to be a novel compound which may be prepared by the method described in Example 1, below.

Trifluoromethyl thiocyanate $CF_3$—S—CN may be prepared by the method described in *Journal of the Chemical Society*, 1963, pages 1272–1274 which comprises the reaction of trifluoromethyl sulfonyl chloride with silver throcyanate.

The present divalent sulfur compounds may be present as the sole dielectric gas, as a mixture of two or more such gases, as a mixture with sulfur hexafluoride or as a mixture of two or more such gases and sulfur hexafluoride. The dielectric gases preferably are free of any ingredient or impurity, other than above dielectric sulfur compounds, that will lower the dielectric strength to any substantial extent, such as to less than about 90% of the strength of pure divalent sulfur compounds or pure mixture of dielectric sulfur compounds. In particular, the dielective gas should not contain appreciable amounts of water vapor or metal particulates.

The present invention contemplates, however, additional ingredients which enhance or do not materially detract from the dielectric strength of the gas. For example, especially in uniform field devices where sulfur hexafluoride is a part of the dielective gas composition, materials such as carbon dioxide, perhalogenated hydrocarbons, nitrogen or air may be used to enhance or dilute without weakening the sulfur hexafluoride; see U.S. Pat. Nos. 4,052,555 and 4,071,461 and pending application of W. H. Mears et al. Ser. No. 767,717, filed Feb. 11, 1977. Similarly, as described in a copending application of M. J. Mastroianni and S. R. Orfeo Ser. No. 919,338, filed June 26, 1978, noble gases may be present, especially when combined with sulfur hexafluoride in dielectric gases for uniform field devices.

When the present divalent sulfur compounds are mixed with sulfur hexafluoride, it is preferred that the mixture contains between about 90 and about 10 mole% sulfur hexafluoride and between about 10 and 90 mole% of one or more of the present divalent sulfur compounds. More preferred is about 40 to 90 mole% divalent sulfur compound. Of the several divalent sulfur compounds, especially preferred for mixture with sulfur hexafluoride are the three bis (perfluoroalkyl) sulfides. Preferred additives to these compositions include nitrogen, air, carbon dioxide, perhalogenated hydrocarbon gases and noble gases.

The present dielectric gas compositions may be present in any high voltage electrical device of the type now using a dielectric gas such as sulfur hexafluoride, with either a uniform of non-uniform field configuration. Examplary of uniform field devices are compressed gas insulative transmission lines as described in A. H. Cookson, COMPRESSED GAS INSULATED TRANSMISSION SYSTEMS: THE PRESENT AND FUTUTRE (Westinghouse Electric Corporation 1978). Exemplary of non-uniform field devices are generators, transformers, circuit breakers and the like. It should be appreciated that in applications such as circuit breakers, the present gases are to be used as the insulating or padding gas and not as the electrical energy absorbing material used to extinguish the arc. The present dielective gas compositions may also be used in other devices where sulfur hexafluoride has been proposed such as the fluidized bed transformers of U.S. Pat. No. 3,889,042 (issued June 10, 1975 to Mears et al.).

EXAMPLE 1 — Preparation of Hexafluorothietane

Into a 1 Hastelloy autoclave cooled to −78° C. is condensed 82g (1.0 moles) of thiocarbonyl fluoride (prepared according to W. J. Middleton, E. G. Howard, and W. H. Sharkey, J. Am. Chem. Soc., 83, 2589 (1961), followed by 100g (1.0 mole) of tetrafluoroethylene. The autoclave is heated to 150° C. for 10 hours. At the end of this period the autoclave is allowed to cool to room temperature and the contents are bled off into a receiver, cooled in a Dry Ice-Acetone bath. Distillation of the product gives the desired $CF_2CF_2CF_2S$ in good yield along with some higher molecular weight by-product.

EXAMPLE 2 — Preparation of Perfluorodiethyl Thioether

A mixture of 22 mmoles $C_2F_4$, 10 mmoles $SF_4$ and 4g anhydrous cesium fluoride was heated at 170° C. for eight hours in a 75 ml Hoke bomb. Separation of the volatile components by gas chromatography gave $C_2F_5SF_2C_2F_5$ in 40% yield. Also isolated were $C_2F_5SF_3$ (7%) and $C_2F_5SSC_2F_5$ (15%).

EXAMPLE 3 — Preparation of Bis (trifluoromethyl) sulfide

Bis(trifluoromethyl) sulfide was prepared by the reaction sequence described in "Inorganic Synthesis" Vol. 14, pp. 42–47 (1975).

Two hundred twenty-four grams (1.64 moles) of $CF_3SCl$ were allowed to react with excess silver trifluoroacetate (578g, 1.80 moles) at 25° C. for 3 hours in a 1 liter, 3-neck flask. The product was distilled from the flask into a −78° C. trap. About 182g. of crude product was recovered. Distillation of this material gave 106g. (0.49 mole) of $CF_3SOCOCF_3$, boiling point 42°–45° C.

Photolysis of $CF_3SOCOCF_3$ (106g., 0.49 mole) for 8 hours at 25° C. through Pyrex glass with a Hanovia ultraviolet quartz lamp (100 watts) produced 75g. of crude $(CF_3)_2S$. On distillation, 48g. (0.28 mole) of $(CF_3)_2S$, crystallization point −22° C., was recovered. The purity was determined to be 99.2% by gas liquid chromatography.

EXAMPLE 4 — Determination of Breakdown Voltage of $(CF_3)_2S$

The breakdown voltage of bis(trifluoromethyl) sulfide was determined by injecting a sample of the material prepared in Example 3 into a 0.1 inch plane to sphere gap at atmospheric pressure and progressively increasing the voltage until breakdown occurred. As shown on the fourth line of Table 1, a value of 26 kV was noted, representing a 50% improvement over $SF_6$.

EXAMPLE 5

Example 4 was repeated for $SF_6$ and mixtures as $SF_6$ and $(CF_3)_2S$ in the proportions indicated in Table 1. The breakdown voltage and percent improvement over pure $SF_6$ are indicated in the table.

TABLE 1

| | Atmospheric Pressure | | | |
|---|---|---|---|---|
| $SF_6$ Mole % | $(CF_3)_2S$ | $(CF_3)O(C_2F_5)$ | BDV | % Improvement |
| 100 | — | — | | 0 |
| 80 | 20 | — | | 12. |
| 60 | 40 | — | | 26. |
| 40 | 60 | — | | 38. |
| 20 | 80 | — | | 45. |
| — | 100 | — | | 50. |

EXAMPLE 5

Examples 3 and 6 were repeated for $SF_6$, $(CF_3)_2S$ and mixtures as shown in Table 2 at 3 atmospheres pressure. The results are displayed in Table 2.

TABLE 2

| | 3 Atmospheres Pressure | | |
|---|---|---|---|
| $SF_6$ Mole % | $(CF_3)_2S$ | BDV | % Improvement |
| 100 | — | | 0 |
| 80 | 20 | | 7. |
| 60 | 40 | | 18. |
| 40 | 60 | | 31. |
| — | 100 | | 42. |

EXAMPLE 6

Following each procedure of Example 4, breakdown voltages were measured at 1, 2 and 3 atmospheres for $SF_6$, $(CF_3)S$ and $(CF_3)O(C_2F_5)$. The results, displayed in Table 3, show that $(CF_3)S$ is superior in breakdown voltage to this perfluoroether.

TABLE 3

| Pressure (Atmospheres) | $SF_6$ | $CF_3OC_2F_5$ | $(CF_3)_2S$ |
|---|---|---|---|
| 1 | 17. | 21. | 25. |
| 2 | 32. | 37. | 44. |
| 3 | 44. | 47. | 62. |

We claim:

1. In an improved high voltage electrical apparatus having at least two electrical conductors separated by an insulative dielectric gas subject to an electrical field, the improvement wherein the insulative dielectric gas comprises between about 0.5 and 100 mole % of a divalent sulfur compound selected from the group consisting of tetrafluororthiirane, hexafluorothietane, bis (trifluoromethyl) sulfide, perfluoromethyl ethyl thioether, perfluorodiethyl thioether, trifluoromethyl thiocyanate and mixtures thereof and 0 to about 99.5 mole % sulfur hexafluoride.

2. The apparatus of claim 1 wherein the insulative dielectric gas is subject to a substantially uniform electrical field.

3. The apparatus of claim 1 wherein the insulative dielectric gas is subject to a non-uniform electrical field.

4. The apparatus of claim 1 wherein the insulative dielectric gas comprises between about 0.5 and 100 mole % bis (trifluoromethyl) sulfide and between 0 and about 99.5 mole % sulfur hexafluoride.

5. The apparatus of claim 2 wherein the insulative dielectric gas comprises between about 40 and about 90 mole percent bis (trifluorormethyl) sulfide.

6. The apparatus of claim 1 wherein said divalent sulfur compound is a thioether selected from the group consisting of bis (trifluoromethyl) sulfide, perfluoromethyl ether thioether and perfluorodiethyl thioether.

7. The apparatus of claim 1 wherein the divalent sulfur compound is selected from the group consisting of tetrafluorothiirane and hexafluorothietane.

8. The apparatus of claim 1 wherein the insulative dielectric gas comprises between about 40 and about 90 mole percent bis(perfluoromethyl) sulfide.

9. A composition of matter comprising between about 10 and about 90 mole % sulfur hexafluoride and between about 10 and about 90 mole % of a divalent sulfur compound selected from the group consisting of tetrafluororthiirane, hexafluorothietane, bis (trifluoromethyl) sulfide, perfluoromethyl ethyl thioether, perfluorodiethyl thioether, trifluoromethyl thiocyanate and mixtures thereof and about 10 to about 90 mole % sulfur hexafluoride.

10. The composition of claim 9 wherein said divalent sulfur compound is bis (perfluoromethyl) sulfide.

* * * * *

UNITED STATES PATENT AND TRADEMARK OFFICE

CERTIFICATE OF CORRECTION

PATENT NO. : 4,166,798

DATED : September 4, 1979

INVENTOR(S) : Mastroianni et al.

It is certified that error appears in the above-identified patent and that said Letters Patent are hereby corrected as shown below:

Column 1, line 35, "howver" should read --however--.

Column 2, top of page, the two formulas should be switched.

Column 2, line 30, "(perfluoralkyl)" should read --(perfluoroalkyl)--.

Column 2, line 31, "(Perfluoroaralkyl)" should read --(Perfluoroalkyl)--.

Column 2, line 40, "Tetrafluorothiirene" should read --Tetrafluorothiirane--.

Column 2, line 40, the formula "$CF_2 - CF_2$" should read --

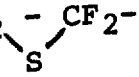

--.

UNITED STATES PATENT AND TRADEMARK OFFICE

CERTIFICATE OF CORRECTION

PATENT NO. : 4,166,798

DATED : September 4, 1979

INVENTOR(S) : Mastroianni et al.

It is certified that error appears in the above-identified patent and that said Letters Patent are hereby corrected as shown below:

Column 2, line 56, "throcyanate" should read --thiocyanate--.

Column 2, line 67, "dielective" should read --dielectric--.

Column 3, line 5, "dielective" should read --dielectric--.

Column 3, line 36, "FUTUTRE" should read --FUTURE--.

Column 3, line 43, "tive" should read -- tric--.

Column 4, line 38, "as" should read --of--.

Column 4, line 55, "EXAMPLE 5" should read --EXAMPLE 6--.

Column 4, line 57, "and 6" should be --and 5--.

Column 5, line 1, "EXAMPLE 6" should read --EXAMPLE 7--.

Column 5, line 10, "$CF_3OC_2F_5$" should read --$(CF_3)O(C_2F_5)$--.

UNITED STATES PATENT AND TRADEMARK OFFICE

CERTIFICATE OF CORRECTION

PATENT NO. : 4,166,798

DATED : September 4, 1979

INVENTOR(S) : Mastroianni et al.

It is certified that error appears in the above-identified patent and that said Letters Patent are hereby corrected as shown below:

Claim 1, line 7, "tetrafluororthiirane" should read

--tetrafluorothiirane--.

Claim 5, line 3, "(trifluorormethyl)" should read

--(trifluoromethyl)--.

Claim 9, line 5, "tetrafluororthiirane" should read

--tetrafluorothiirane--.

Signed and Sealed this

*Fifteenth* Day of *January 1980*

[SEAL]

*Attest:*

SIDNEY A. DIAMOND

*Attesting Officer* *Commissioner of Patents and Trademarks*